US006107585A

United States Patent [19]

Gehr

[11] Patent Number: 6,107,585

[45] Date of Patent: Aug. 22, 2000

[54] BUTTON SWITCH

[75] Inventor: Glenn E. Gehr, New Holland, Pa.

[73] Assignee: LoreTech, Ltd., Ephrata, Pa.

[21] Appl. No.: 09/296,672

[22] Filed: Apr. 22, 1999

[51] Int. Cl.[7] ..... H01H 3/02

[52] U.S. Cl. ..... 200/505; 200/341

[58] Field of Search ..... 200/282, 510, 200/505, 302.2, 341, DIG. 2

[56] References Cited

U.S. PATENT DOCUMENTS 3,950,627 4/1976 Murata et al. ..... 200/159 R
4,968,860 11/1990 Shinohara et al. ..... 200/314

OTHER PUBLICATIONS

"AbleNet Switches . . . the best in the Business," 1998 Catalog, pp. 6–7.

*Primary Examiner*—Michael L. Gellner
*Assistant Examiner*—Nhung Nguyen
*Attorney, Agent, or Firm*—Morgan, Lewis & Bockius LLP

[57] ABSTRACT

The invention includes a switch designed for use in adverse conditions such as for use with physically challenged persons. The switch can include a housing comprising top and bottom housings. The top and bottom housing each have a mating surface which guide the top and bottom housing during activation of the switch while permitting an activation force applied from various directions to activate an electrical switch located within the housing. The switch can include a flange type seal member for resisting entrance of contaminants into the housing and can include a ring member for attaching the switch to a user's body for easy manipulation of the switch. In addition, the switch is designed to be quickly and easily fit together during assembly and therefore easily manufactured.

16 Claims, 19 Drawing Sheets

BUTTON SWITCH

RELATED APPLICATION

This application is related to a design patent application which is commonly owned by the assignee of this application and which is incorporated by reference. The related application is: application Ser. No. 29/103,792, by inventor Glenn E. Gehr, entitled "BUTTON SWITCH", filed Apr. 22, 1999.

BACKGROUND OF THE INVENTION

1. Field of the Invention

The present invention relates to an improved electrical switch. More specifically, the present invention relates to an ergonomically shaped electrical switch that is ideally suited for use in adverse environments, e.g., for use with persons who are physically challenged.

2. Discussion of the Related Art

Conventional switches generally include a large number of parts making them bulky and difficult to manufacture, assemble, and use. In many switches, an upper cover is fastened by screws to a fastening plate in a lower cover. One or more springs located between the lower cover and upper cover resiliently attach the upper and lower covers for movement relative to each other. Often, a wall is located inside the switch to guide the movement of the upper and lower covers relative to each other. Substantial vertical force must be applied to the switch for activating the electrical switch mechanism located inside the conventional switch. Various attempts have been made to provide a switch that can be activated by application force received from different angles. However, such attempts have resulted in a complex design for the switch in which many complex parts are required.

In addition, some conventional switches are designed for use in adverse environments, such as with physically challenged persons, and generally lack ergonomic and aesthetic value. Moreover, conventional switches are utilitarian in design and fail to take into account the needs of particular applications for a switch.

Other problems exist with respect to conventional switches, some of which are discussed in further detail below. A need exists for an improved switch that solves the problems described herein.

SUMMARY OF THE INVENTION

Accordingly, the present invention is directed to a switch having an ergonomic design and which is adapted for use in adverse environments. Specifically, the switch provides great benefits to those persons who are physically challenged and require a switch device for communication and/or activation of other mechanisms or systems. The present invention is comprised of relatively few parts and may be "snap-fit" to assemble and therefore simple to manufacture. Improved and mating contact surfaces located within the housing act to guide the cooperating elements to activate the switch substantially regardless of the direction of the application force. The mating contact surfaces also distribute switch activation forces evenly throughout the housing of the switch once the mating contact surfaces are pressed into contact by the activation force. Furthermore, the present invention can include a seal member for resisting entry of contaminants into the switch housing, and can include a ring member for attaching the switch to a user's body.

Additional features and advantages of the present invention will be set forth in the description of the drawings that follows, and in part will be apparent from the description, or may be learned by practice of the invention. The objectives and other advantages of the invention will be realized and attained by the process particularly pointed out in the description and claims hereof as well as the appended drawings.

In an aspect of the invention, the electrical switch includes a top housing having a top mating surface, a bottom housing having a bottom mating surface adapted to cooperate with the top mating surface such that activation forces applied to the top housing are evenly transmitted to the bottom housing, a spring mechanism disposed between the top housing and the bottom housing, and an electrical switch located between the top housing and the bottom housing.

In another aspect of the invention the switch includes a housing having a top portion and a bottom portion moveable between a first position wherein the top and bottom portions are in contact and a second position wherein the top and bottom portions are out of contact, the housing includes means for distributing a switch activation force evenly throughout the bottom housing while permitting the switch to be activated by switch activation forces directed from one of a plurality of different directions, and an electrical switch disposed between the top portion and the bottom portion and activated by relative movement between the top and bottom portions.

In yet another aspect of the invention, the switch includes a top housing including an exterior member flexible in a radial direction, a bottom housing movably connected to the top housing and including a ridge member which cooperate with the extension member to secure the top housing to the bottom housing, and an electrical switch located between the top housing and the bottom housing and activatable by movement of the top housing relative to the bottom housing.

In a further aspect of the invention, the switch includes a top housing and a bottom housing movably connected to each other, an electrical switch located between the top housing and the bottom housing and activatable by movement of the top housing relative to the bottom housing, and a ring member located adjacent the bottom housing and configured to be attachable to a user's body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of the specification, illustrate one embodiment of the invention and together with the written description serves to explain the principles of the invention. In the drawings.

DETAILED DESCRIPTION OF THE DRAWINGS

The accompanying drawings, which are included to provide a further understanding of the invention and are incorporated in and constitute a part of this specification, illustrate embodiments of the invention that together with their associated description serve to explain the principles of the invention.

Figure 1:
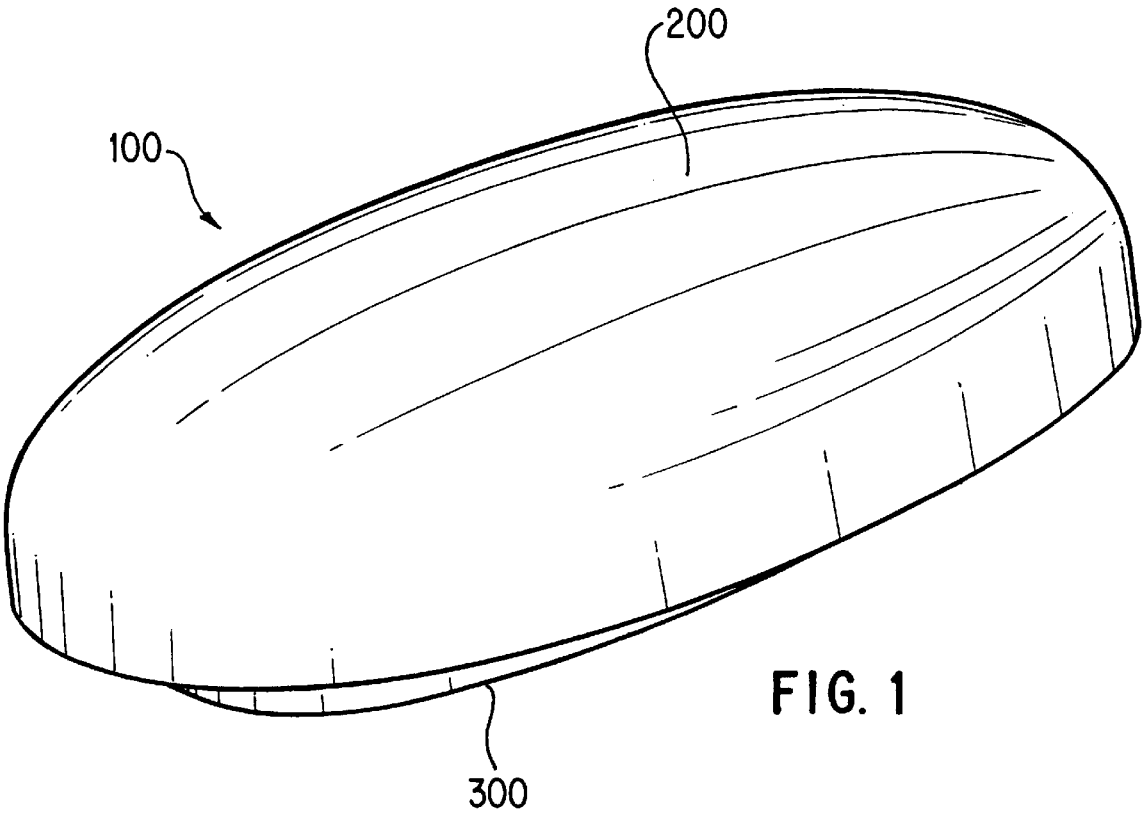
FIG. 1 is an isometric top view of a switch in accordance with an embodiment of the invention.
Figure 2:
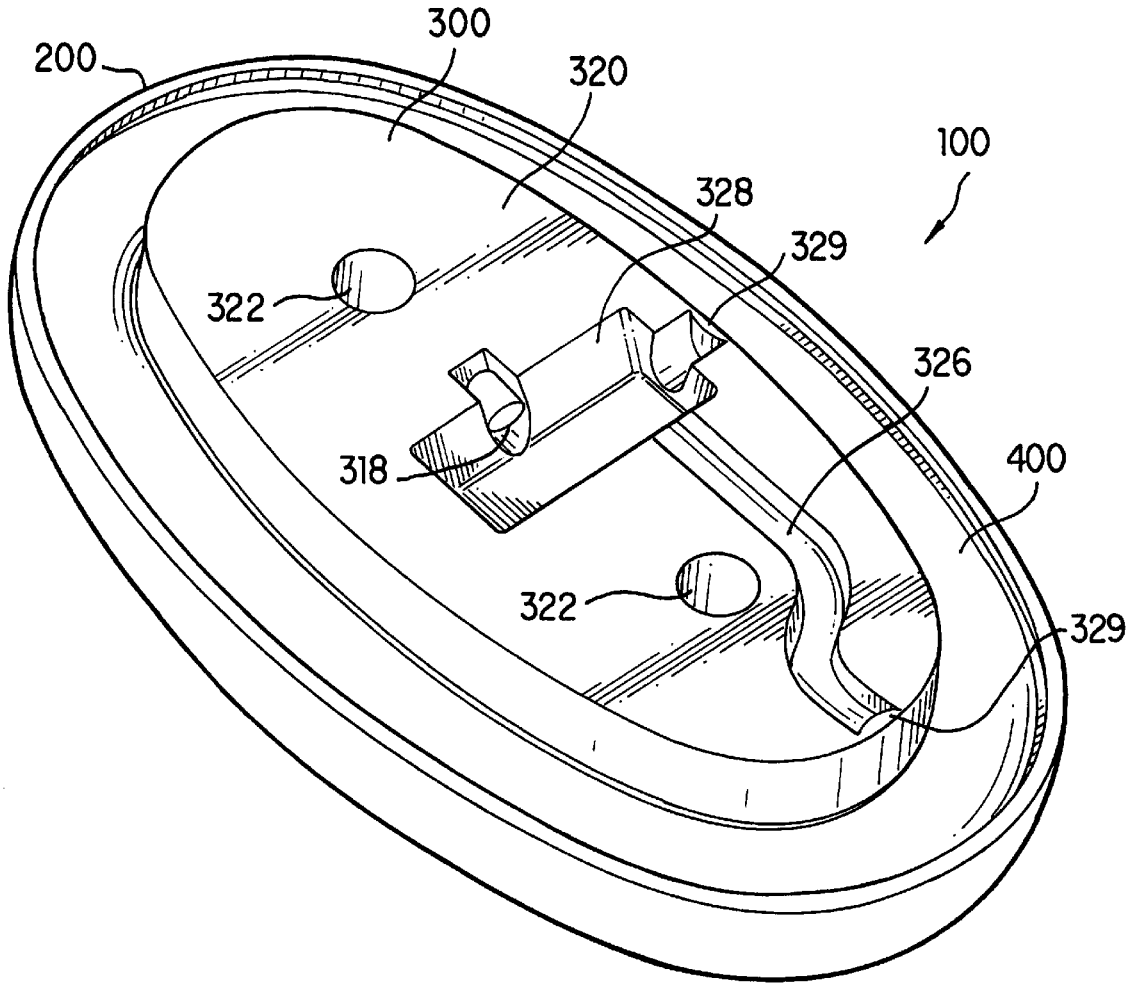
FIG. 2 is an isometric bottom view of the switch of FIG. 1.

FIGS. 1 and 2 illustrate a switch 100 according to an embodiment of the present invention. Switch 100 may include a housing, for example a top housing 200 and a bottom housing 300.

As shown in FIG. 2, a seal member 400 is disposed between the top housing 200 and the bottom housing 300 to resist entry of water, food particles, dirt, or other contaminants into the switch 100. The top housing 200 is generally oval in shape with a smooth surface and is ergonomically constructed such that a user can activate the switch by depressing the top housing 200 at various angles and over a large amount of the top housing's surface area. The shape of the top housing 200 is similar to an oblong button and provides the device a sleek aesthetic appeal such that the switch can be used on an outwardly exposed portion of a structure. For example, in a preferred application of the invention, the switch 100 can be used in conjunction with a body support device for use by a physically challenged person, such as at a temple pad of a headrest. The switch can be located either within a pad located on the body support device or can be exposed on an outward surface of the support device.

The bottom housing lower surface 320 includes several structures and features facilitating connection of the switch to other structures. First and second wireways 325 and 326, respectively, permit an electrical wire to extend from first and second different directions away from the bottom housing lower surface 320 while the bottom housing lower surface remains flush with a surface to which it is connected. The wireways 325 and 326 include knockout portions 329 at their respective ends to allow for an appropriate seal with the mounting surface for the unused wireway. Wire aperture 318 ultimately provides access for the wire into the switch. Indent 328 forms a shelf 309 on the bottom housing upper surface to correctly position the electrical switch 500 at a predetermined distance from the flat spring 650 and top housing 200 to ensure consistent switch activation. In addition, the indent 328 located on the bottom housing lower surface 320 can work in cooperation with an outdent on an attachment structure to which the switch 100 is to be secured. The indent 328 and outdent can cooperate to securely locate and position the switch on the attachment structure. Screw holes 322 can also be provided in the bottom housing lower surface 320 for connecting the switch 100 to another structure.

FIGS. 3*a*–3*f* illustrate an alternative embodiment of the invention in which a ring structure 800 is selectively and rotatably attached to the bottom housing lower surface 320 of the switch 100. The ring structure includes a separate first ring half 810 and second ring half 820 that include a first semicircular portion 814 and a second semi-circular portion 824, respectively. The first and second semi-circular portions 814 and 824 are made from a generally flexible material and can be configured to fit around an appendage of a user. Accordingly, with appropriate sizing, a user can attach the switch 100 to his or her arm, finger or other body part such that the switch can be easily manipulated and activated by the user. In addition, the ring structure 800 can be removably and quickly attached to a tube, rod or other structure at various different locations at the preference of a user.

Figure 3A:
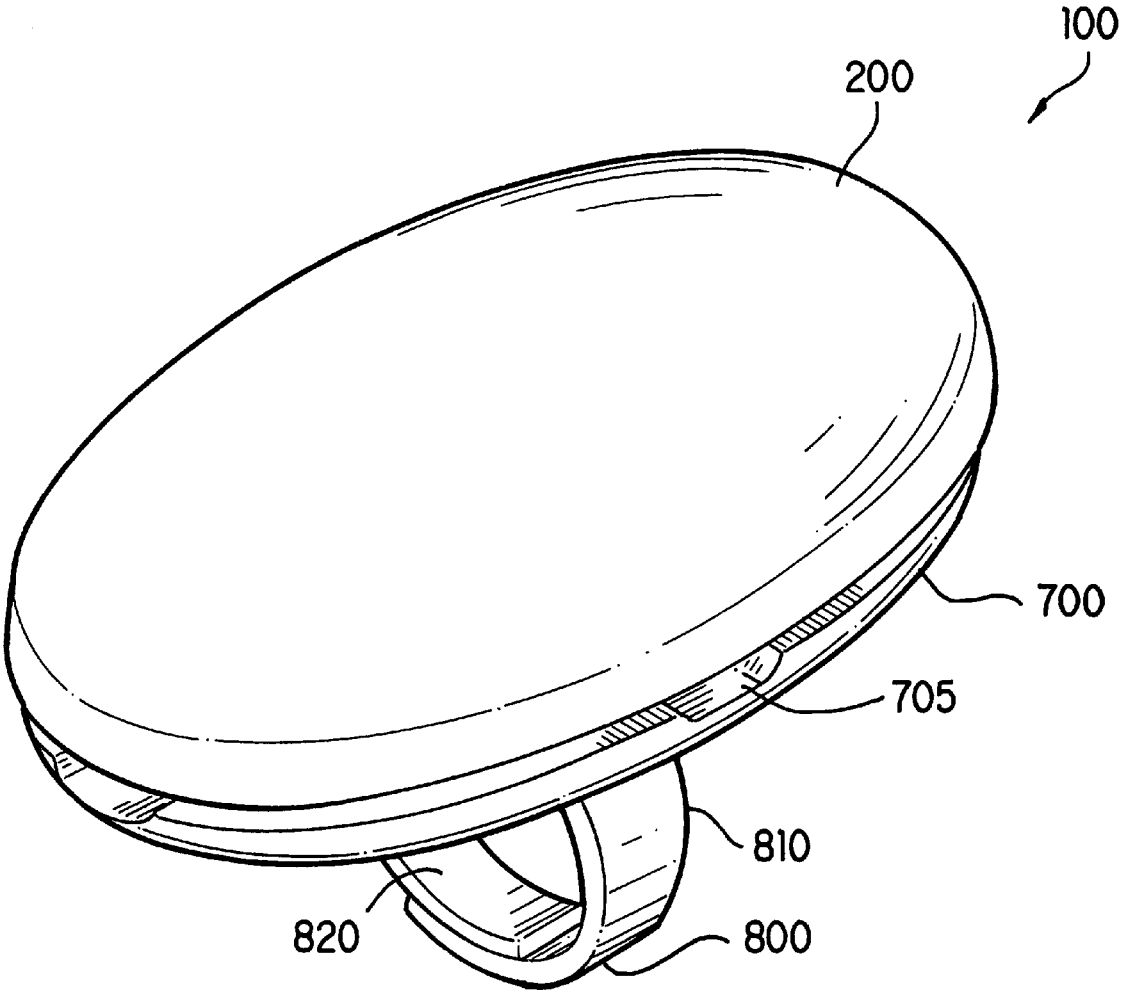
FIGS. 3A–F are isometric top, isometric bottom, top, bottom, front and left views of a switch in accordance with another embodiment of the invention.
Figure 3B:
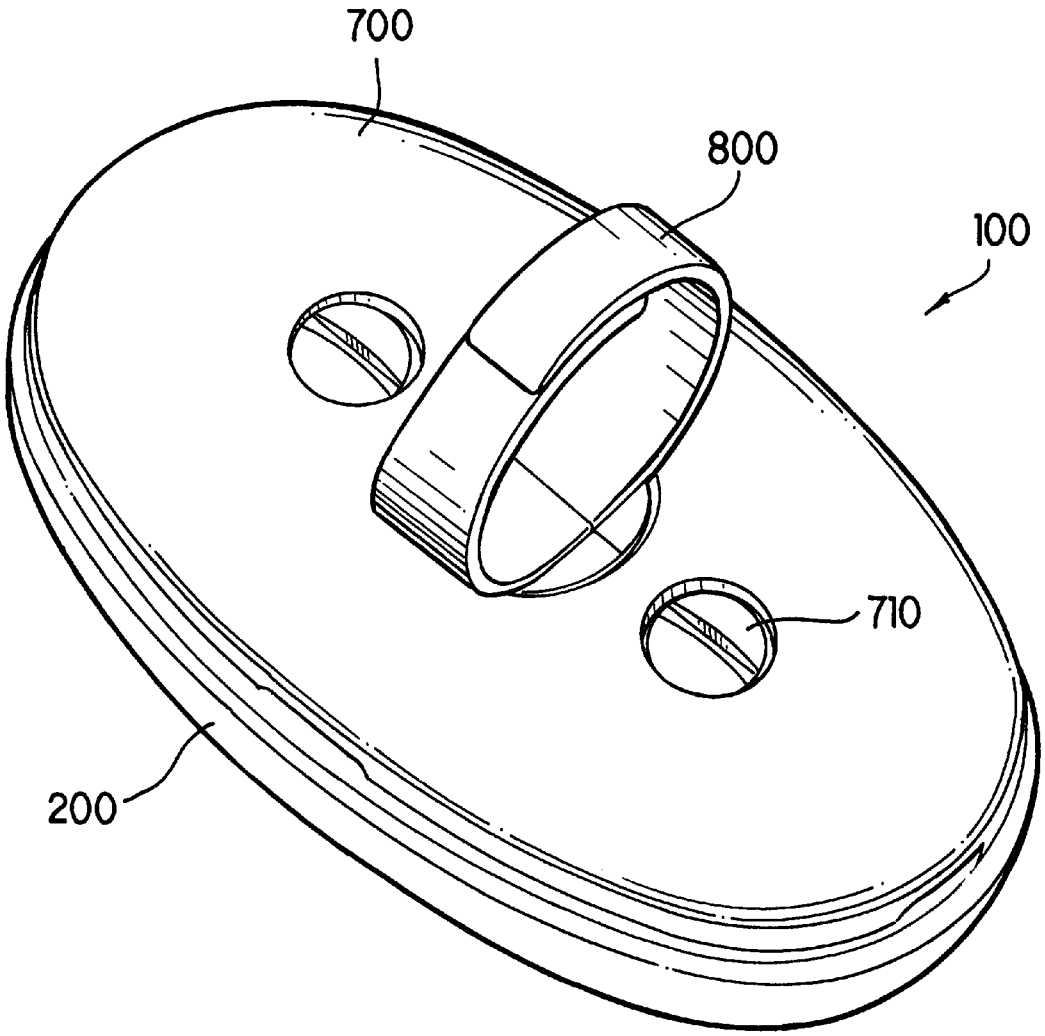
Figure 3C:
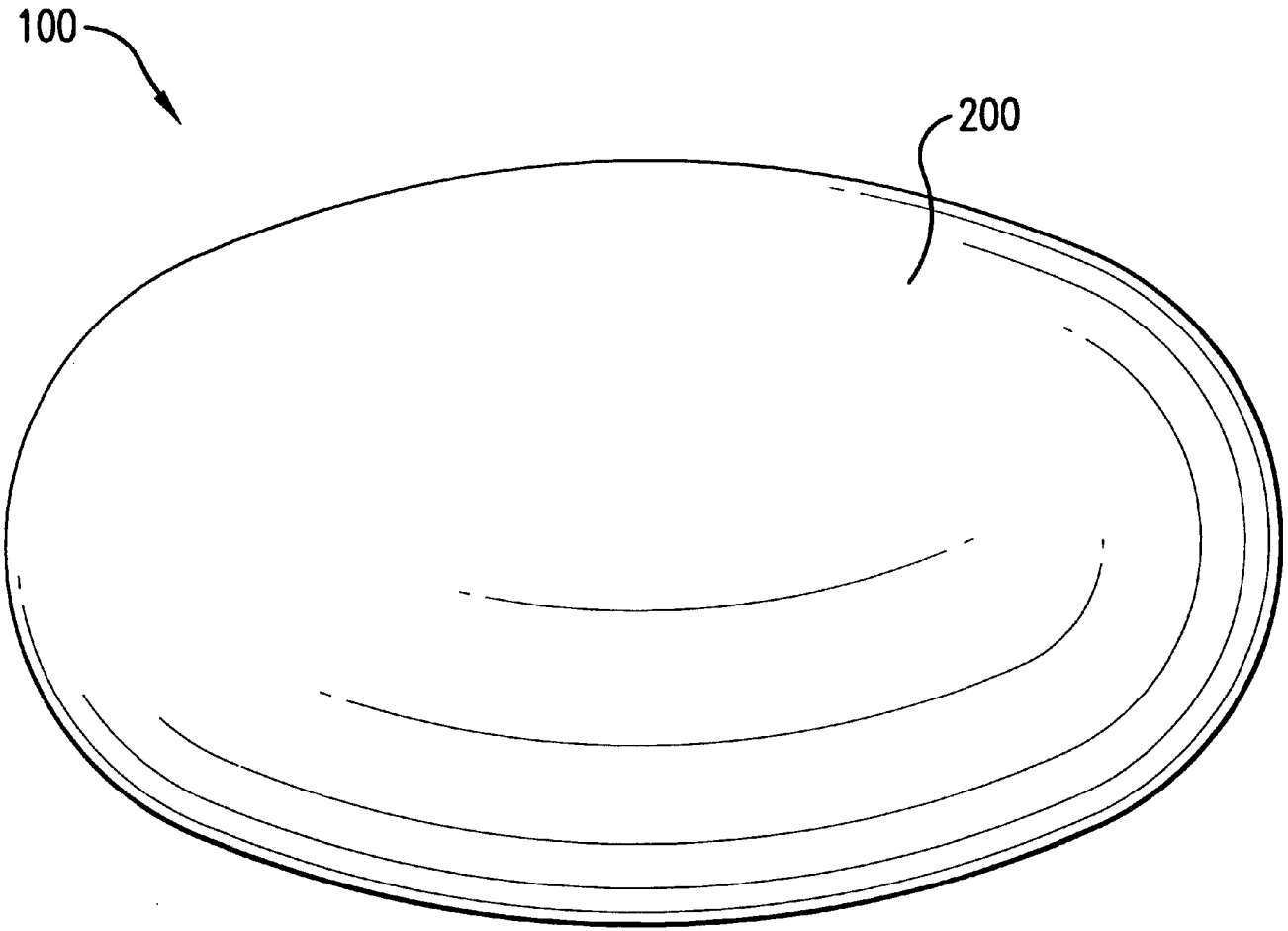
Figure 3D:
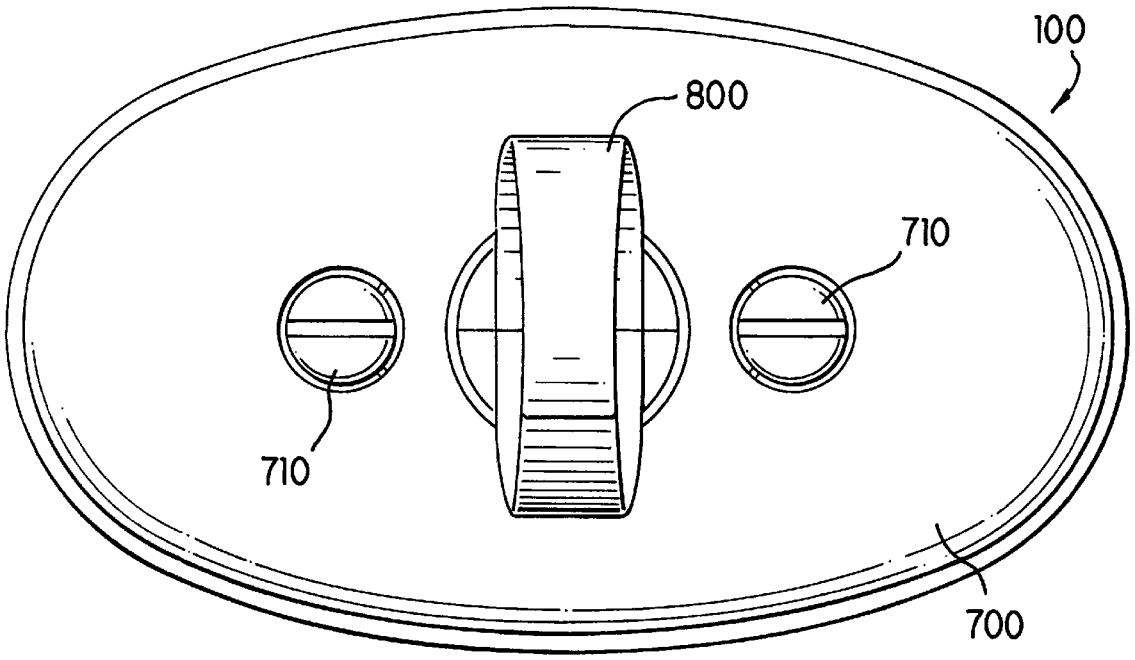
Figure 3E:
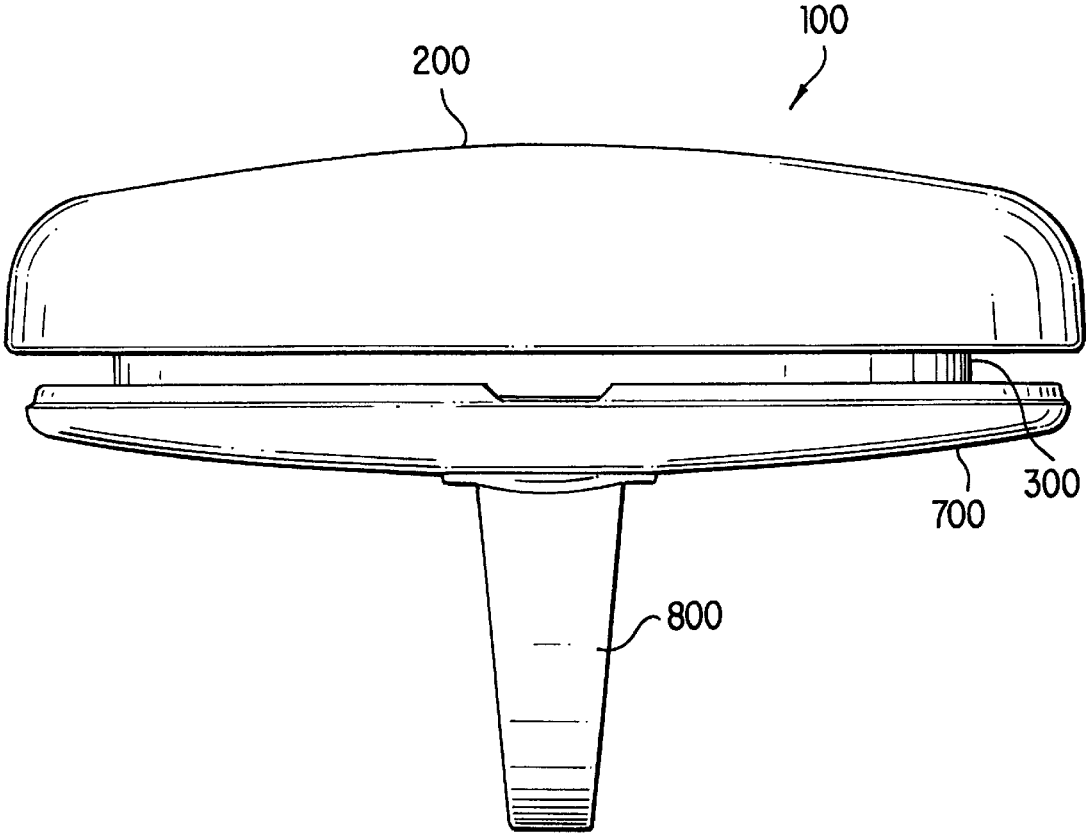
Figure 3F:
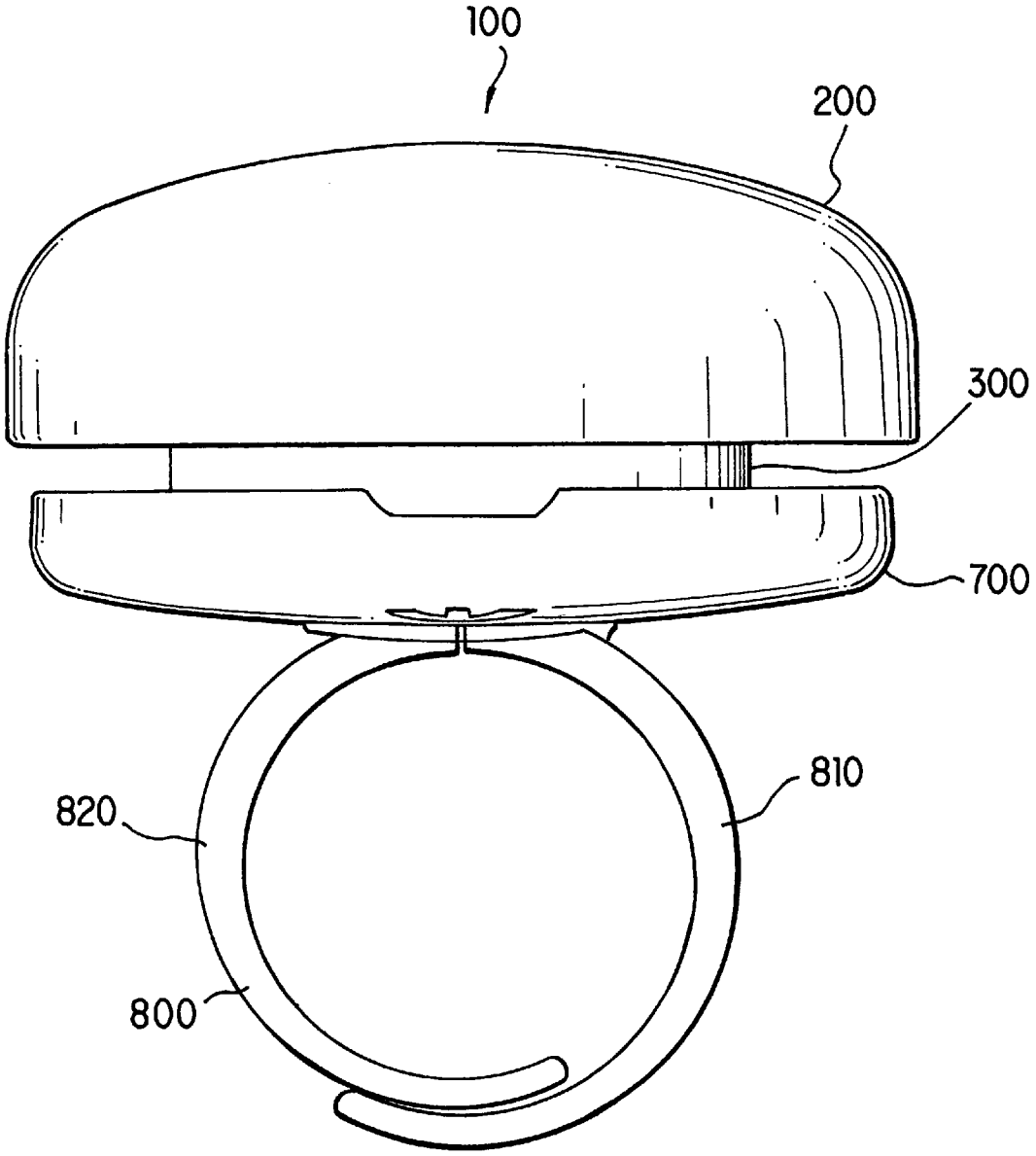
Figure 4:
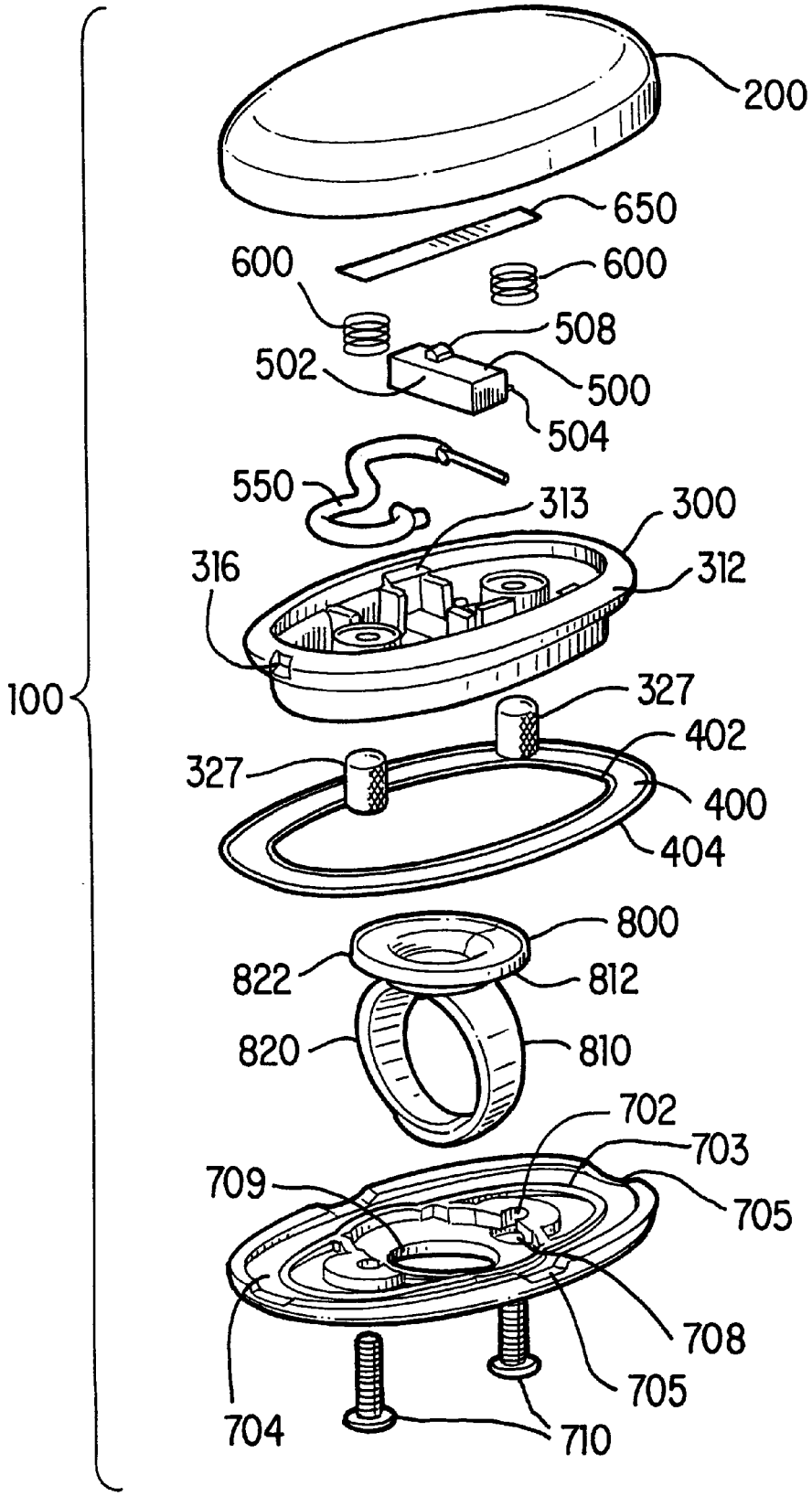
FIG. 4 is an exploded view of the switch shown in FIGS. 3A–F.

The ring structure 800 can be rotatably and selectively attached to the bottom housing lower surface 320 via a ring cover plate 700. The ring cover plate 700 is attached to the bottom housing lower surface 320 by screws 710 threaded into threaded inserts 327 located in screw holes 322 (as shown in FIG. 3*b* and 4). The threaded inserts 327 can be molded into the screw holes and are preferably made from brass with a knurled outer surface to better secure them when molded into screw holes 322.

The ring structure 800 includes a first base half 812 and second base half 822 which combine to form a disc structure that can be disposed between the ring cover plate 700 and the bottom housing of the switch. The disc structure formed by the first and second base halves, 812 and 822, is located within a ring aperture 709 in the ring cover plate 700. Screw thruways 708 provided adjacent the screw holes 702 in the ring cover plate 700 permit screws 710 to be tightened against diametrically opposed portions of the disc type structure formed by the first and second base halves 812 and 822 of the ring structure 800. Accordingly, the ring structure 800 can be secured at various rotational positions with respect to the lower surface 320 of the bottom housing by tightening screws 710 onto the disc structure of the ring 800. The selective rotation feature for the ring structure 800 provides the ability to orient the switch 100 in a variety of configurations depending on a user's particular needs and/or the specific application for the switch.

It should be appreciated that the ring structure 800, ring cover plate 700, and top and bottom housings 200 and 300 with connective seal member 400 each include separate ornamental features that, either alone or in combination with each other, add to the aesthetic appeal of the switch 100 and provide a generally streamlined appearance. With regard to the aesthetic appearance of the invention, it should also be understood that the attached drawings are computer based renderings that include facet type markings that denote shading and delineate smooth surfaces. The outward surfaces of the switch components are preferably smooth and sleek in appearance. If preferred, however, the surfaces could be roughened, textured or patterned to provide better frictional qualities without departing from the scope and spirit of the invention.

Figure 5A:
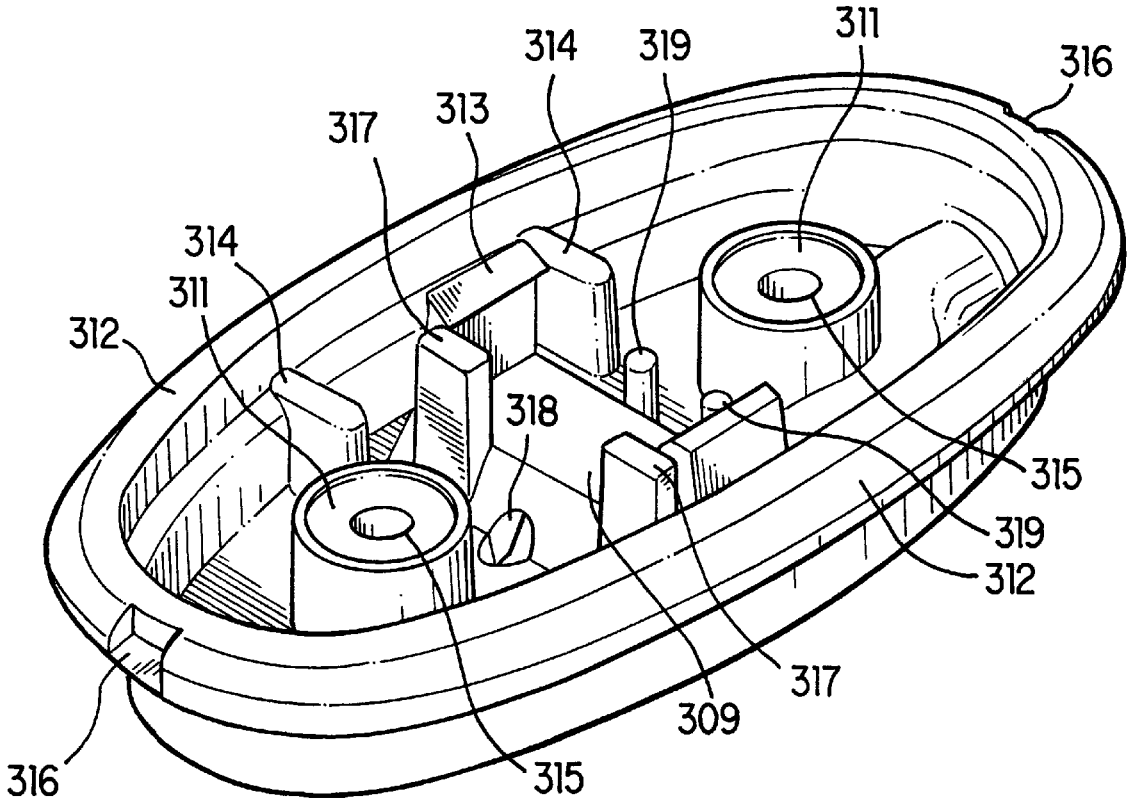
FIGS. 5A–C are isometric top, isometric bottom, and top views of the bottom housing shown in FIG. 1.
Figure 5B:
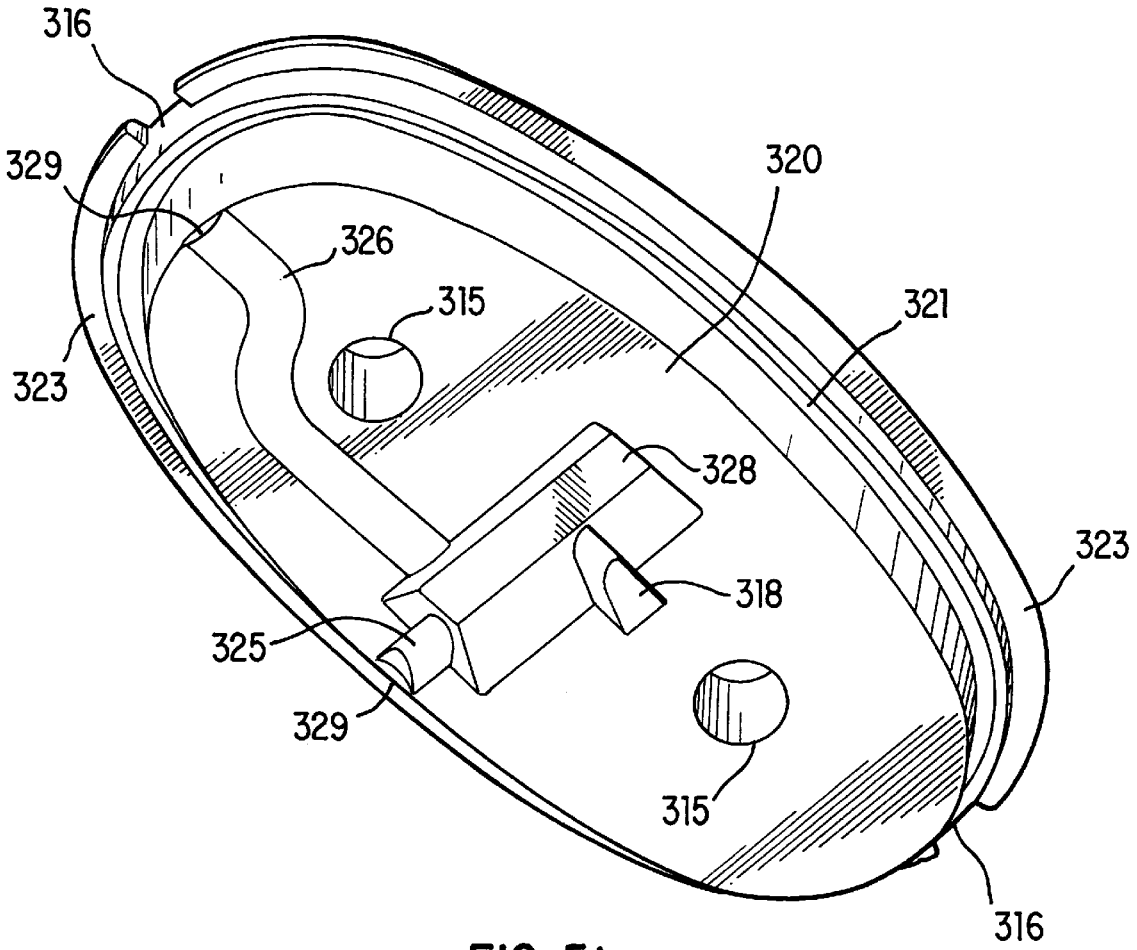
Figure 5C:
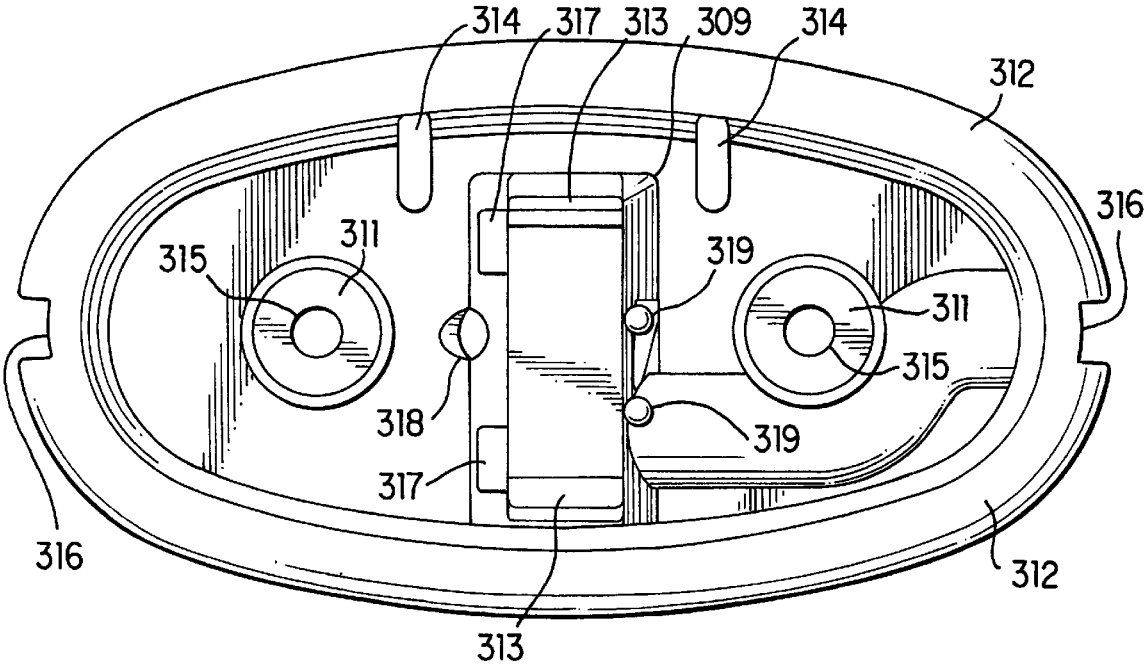
Figure 6A:
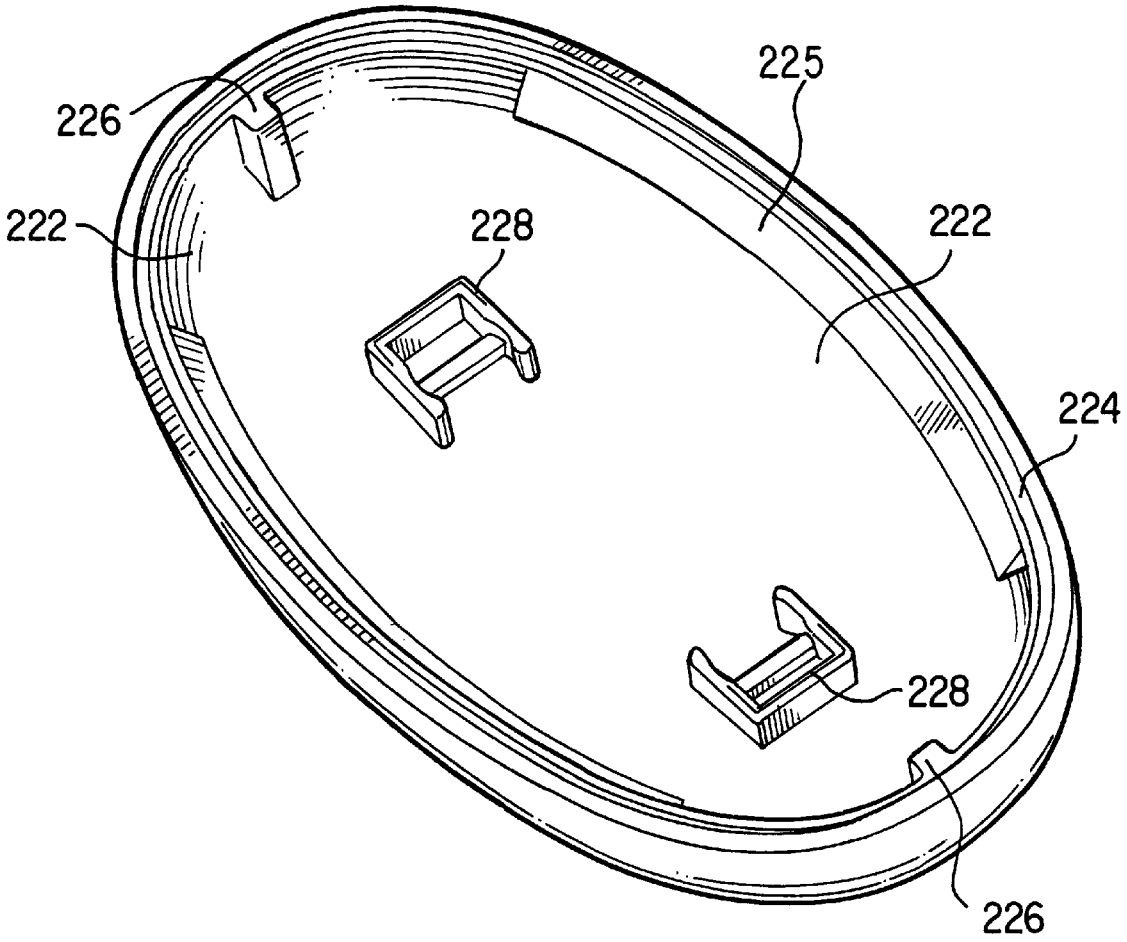
FIGS. 6A–B are isometric and bottom views of the top housing shown in FIG. 1.
Figure 6B:
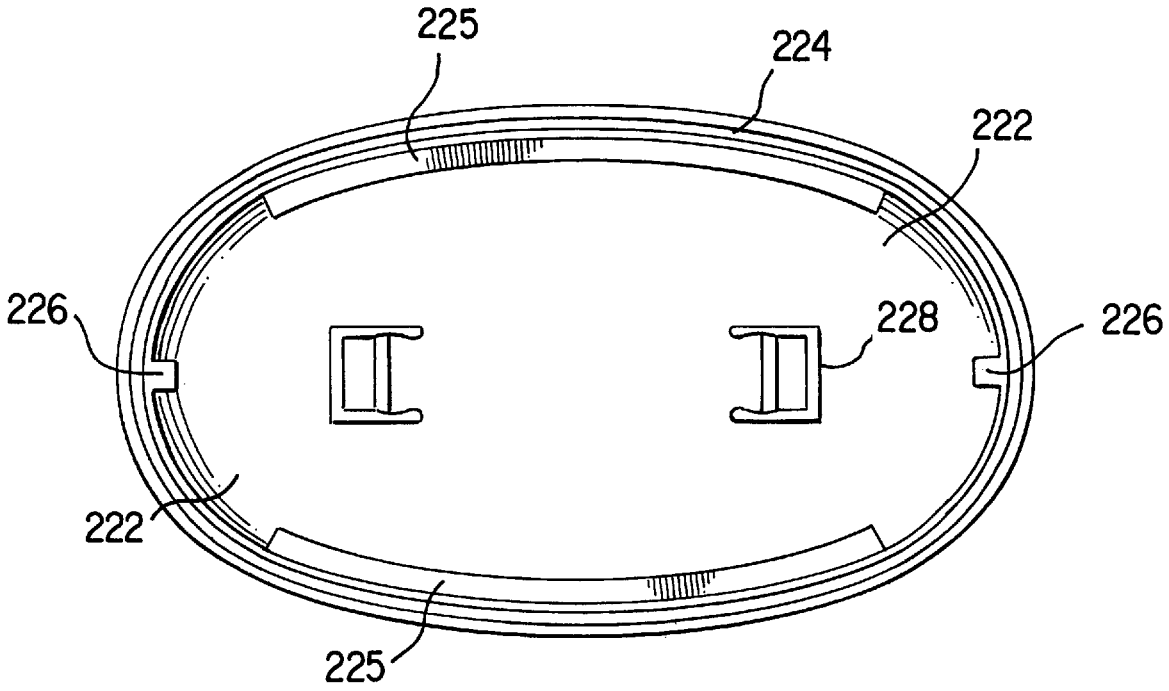
Figure 7A:
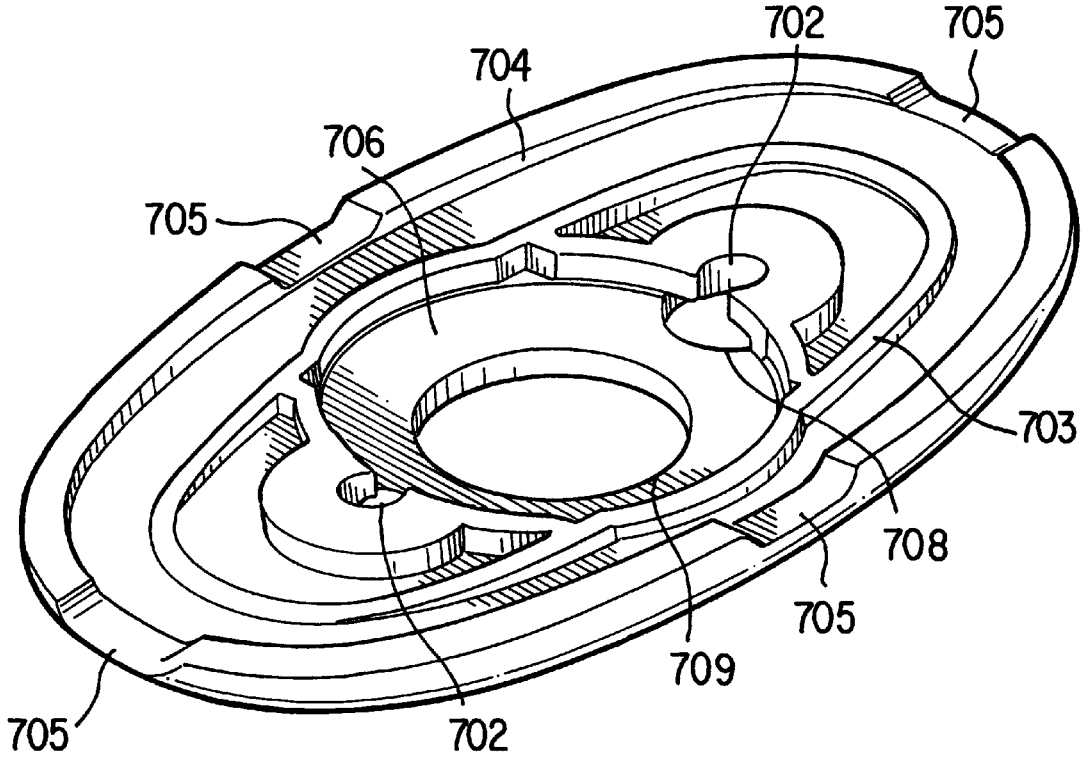
FIGS. 7A–B are isometric and top views of the ring cover shown in FIGS. 3A–F.
Figure 7B:
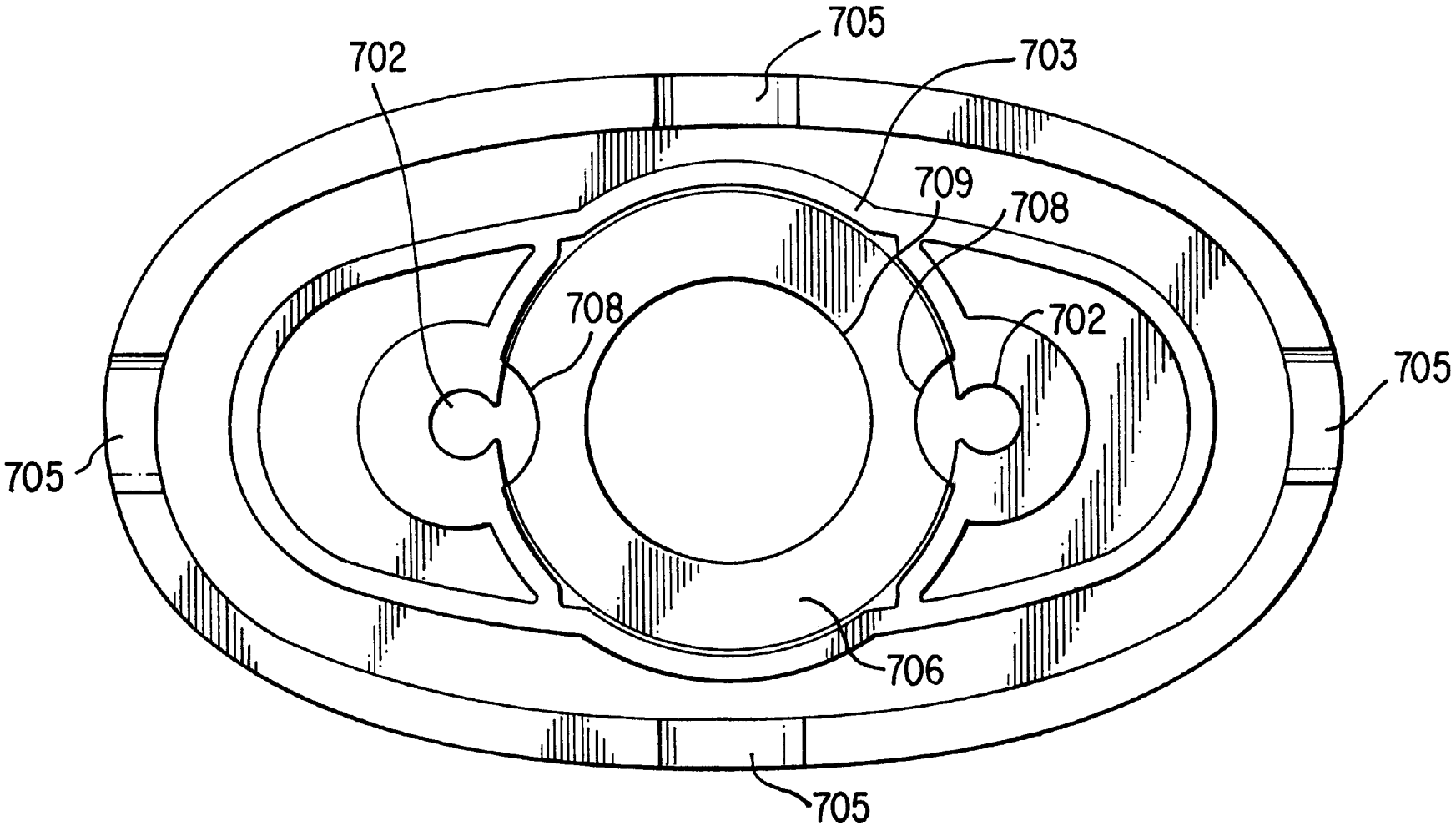
Figure 8A:
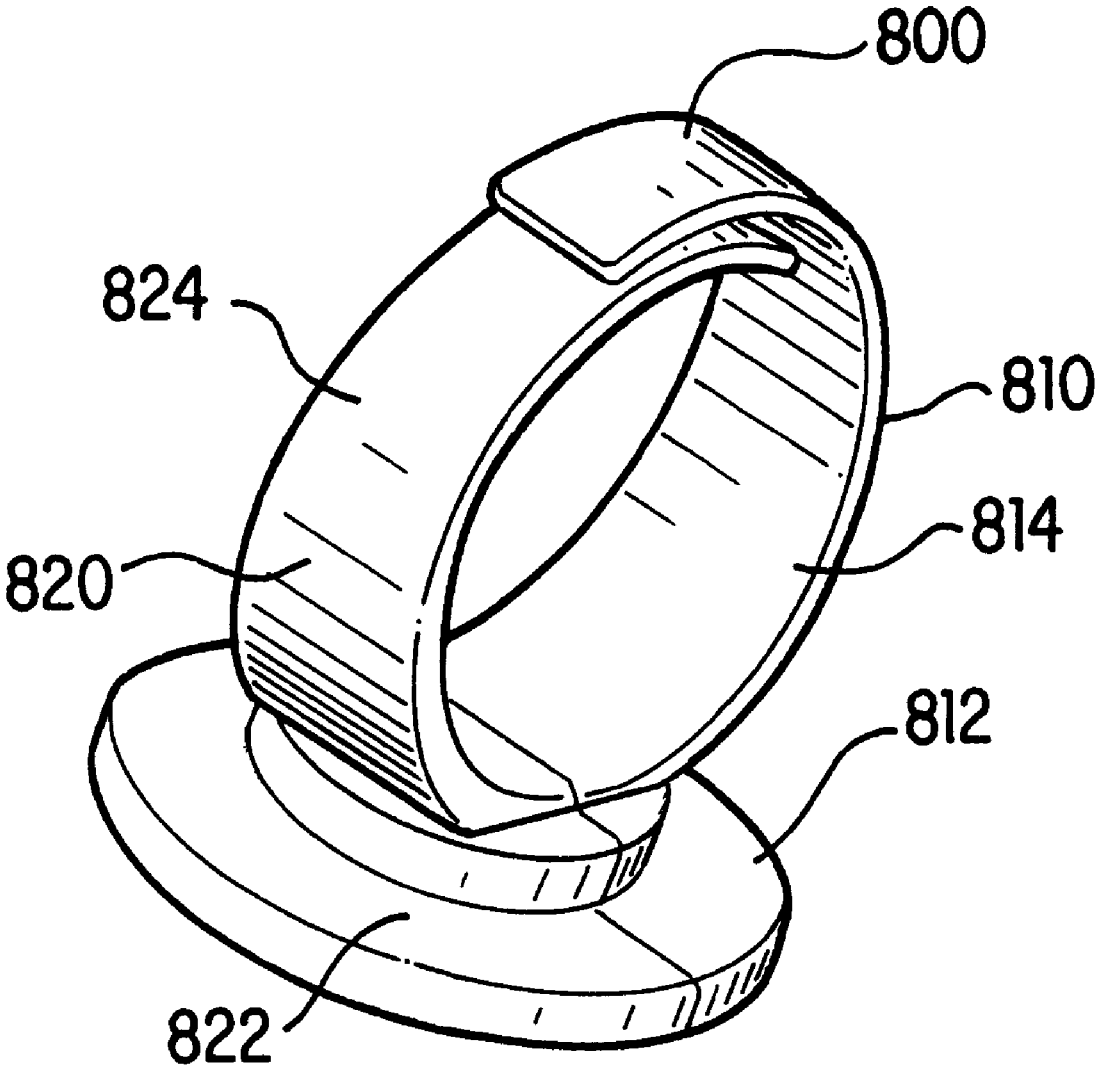
FIGS. 8A–B are isometric and top views of the ring structure shown in FIGS. 3A–F.
Figure 8B:
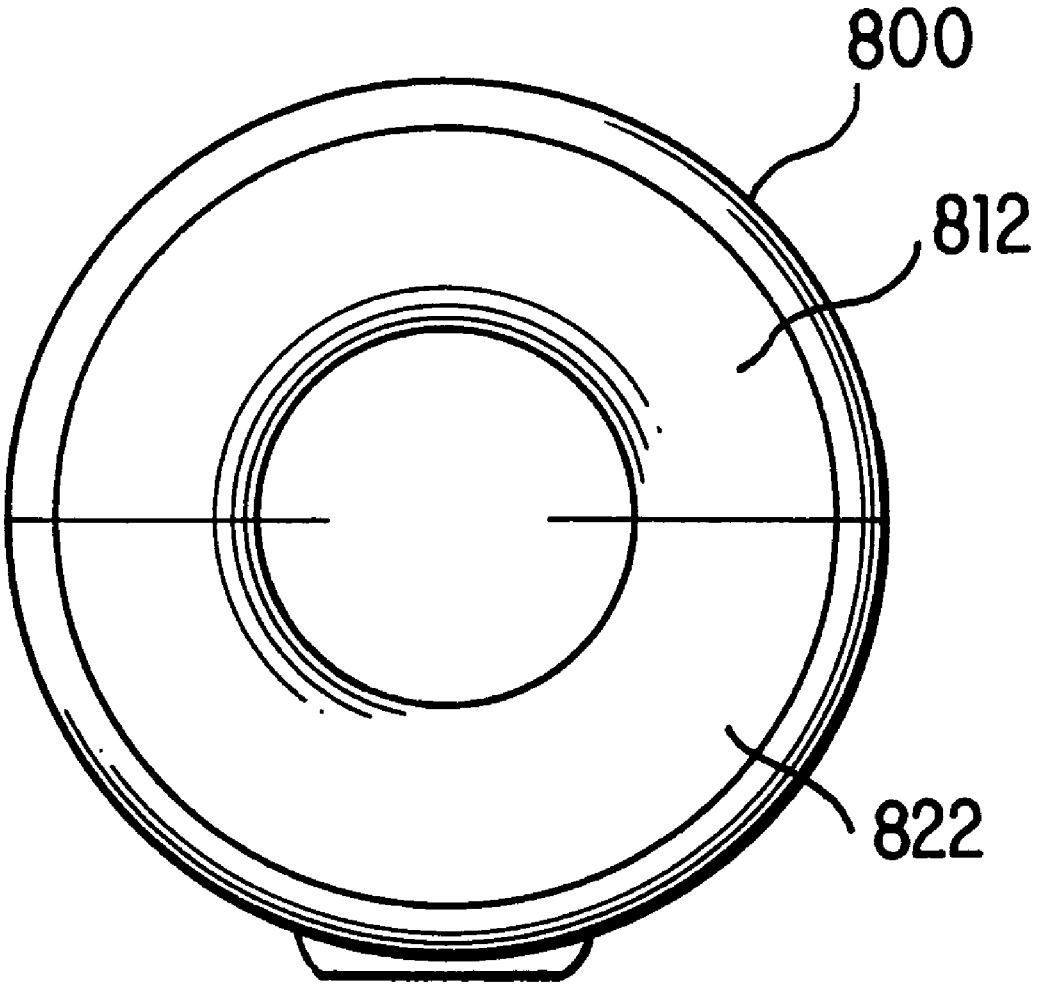

FIG. 4 illustrates an exploded view of the inventive switch 100. As shown, the top and bottom housings 200 and 300, respectively, encase an electronic switch 500. Clips 313 and guide members 317 secure the switch body 502 to the bottom housing 300. A wire 550 is connected to leads 504 of the electronic switch 500 to provide electronic communication between the electronic switch and an outside device. Activation button 506 located at the top of the switch body 502 can be activated by flat spring 650 when a downward activation force is applied to the exterior of the top housing 200. The top housing is slightly larger than the bottom housing and can be movably attached over the bottom housing to slide from a first activation position to a second rest position. The top housing 200 is biased away from the bottom housing 300 and toads the rest position by springs 600 located between spring platforms 311 on the bottom housing and rib structures 228 (as shown in FIG. 5*a*) on the top housing. Clips 225 on either interior side of the top housing act in conjunction with a lower ledge 323 located around the outer perimeter of the bottom housing to stop the top housing at its second rest position. Location indents 316 provided at either end of the bottom housing 300 mate with location out dents 226 at the inner surface of the top housing to orient the top and bottom housings during movement relative to each other. Seal ridges 321 and 224 of the top and bottom housings secure an inner lip 402 and an outer lip 404 of seal member 400 (as best shown in FIGS. 5*b* and 6*a*) therein to seal the housings and protect the switch from contaminants.

As explained above, the ring structure 800 can be rotatably attached to the bottom housing 300 by ring plate cover 700. A ring indent 706 provided on the interior surface of the ring plate cover 700 secures the ring structure 800 in an outward orientation while permitting rotation about a longitudinal axis of the ring structure. In addition, a location shelf 704 disposed about the inner periphery of the ring plate cover 700 mates with the lower surface 320 of the bottom housing to insure proper alignment between the ring plate cover 700 and bottom housing 300.

FIGS. 5*a*–6*b* illustrate the top and bottom housings 200 and 300, respectively, of the switch. Mating surfaces 312 and 222 are disposed on an outer edge of the bottom housing 300 and on an interior surface of the top housing 200, respectively. The mating surfaces are configured to exactly mate, or at least substantially mate, with each other in order to disperse switch application forces evenly throughout the housings when the top housing 200 is depressed by an activation force and caused to move into contact with the bottom housing 300. In operation, the top housing is depressed by a user to activate the switch. The top housing is then guided substantially directly downward by the geometry of the mating surface regardless of the direction or angle in which the user is applying force to the top housing. As the top housing moves downward, flat spring 650 contacts activation button 506 to activate the electronic switch 500. The top housing and bottom housing remain movable even after activation of the electronic switch 500 due to the flexibility of the flat spring 650 in combination with the stroke length for the activation button to relieve stress on the electronic switch 500. The top and bottom housings continue relative movement until their mating surfaces contact each other. Accordingly, resultant stress created by the activation force is primarily received and distributed by contact between the top and bottom housing mating surfaces 222 and 312, respectively, and not the electronic switch 500. The amount of surface area that is in contact during activation of the switch is inversely proportional to the amount of stress received by the contacting areas. Accordingly, the large contact surface area of the invention distributes the activation force and reduces the strain on each of the housings.

In addition, the mating surfaces 312 and 222 are arcuate and 3-dimensional, and therefore provide guidance to the housings as they move relative to each other. The configuration of the mating surfaces permits the switch to be easily activated substantially regardless of the directional orientation of the activation force.

The top and bottom housings 200 and 300, respectively, also include structure for quick and easy connection between each other. Specifically, a projection 225 located on an inner surface of the top housing 200 can flex outward to ride over an outer periphery of the bottom housing 300 and frictionally engage a ridge 323 located on the bottom housing 300. Once in place, the top and bottom housing are movably secured to each other between a first position in which the clip 225 is biased into contact with ridge 323 by springs 600 and a second position in which the flat spring 650 contacts switch button 506 and in which mating surfaces 222 and 312 contact each other to terminate movement between the housings. No complex attachment structure is necessary to movably attach the top and bottom housings. Accordingly, manufacture and assembly of the switch is relatively simple and economical.

FIGS. 7*a*–8*b* illustrate the ring cover plate 700 and ring structure 800 as described in detail above. The ring cover plate 700 includes ribs 703 for providing structural support to the cover plate 700 and for abutting against the lower surface 320 of the bottom housing to ensure correct spacing when attached thereto. The ring cover plate 700 also includes wire thruways 705 located at 90 degree intervals about the periphery of the ring plate cover 700. Wire thruways 705 provide space for a wire to enter or exit the switch. However, if the distance between the ring cover plate 700 and the bottom housing 300 is sufficient, the wire thruways 705 can be eliminated to provide a sleeker aesthetic design for the switch.

Figure 9:
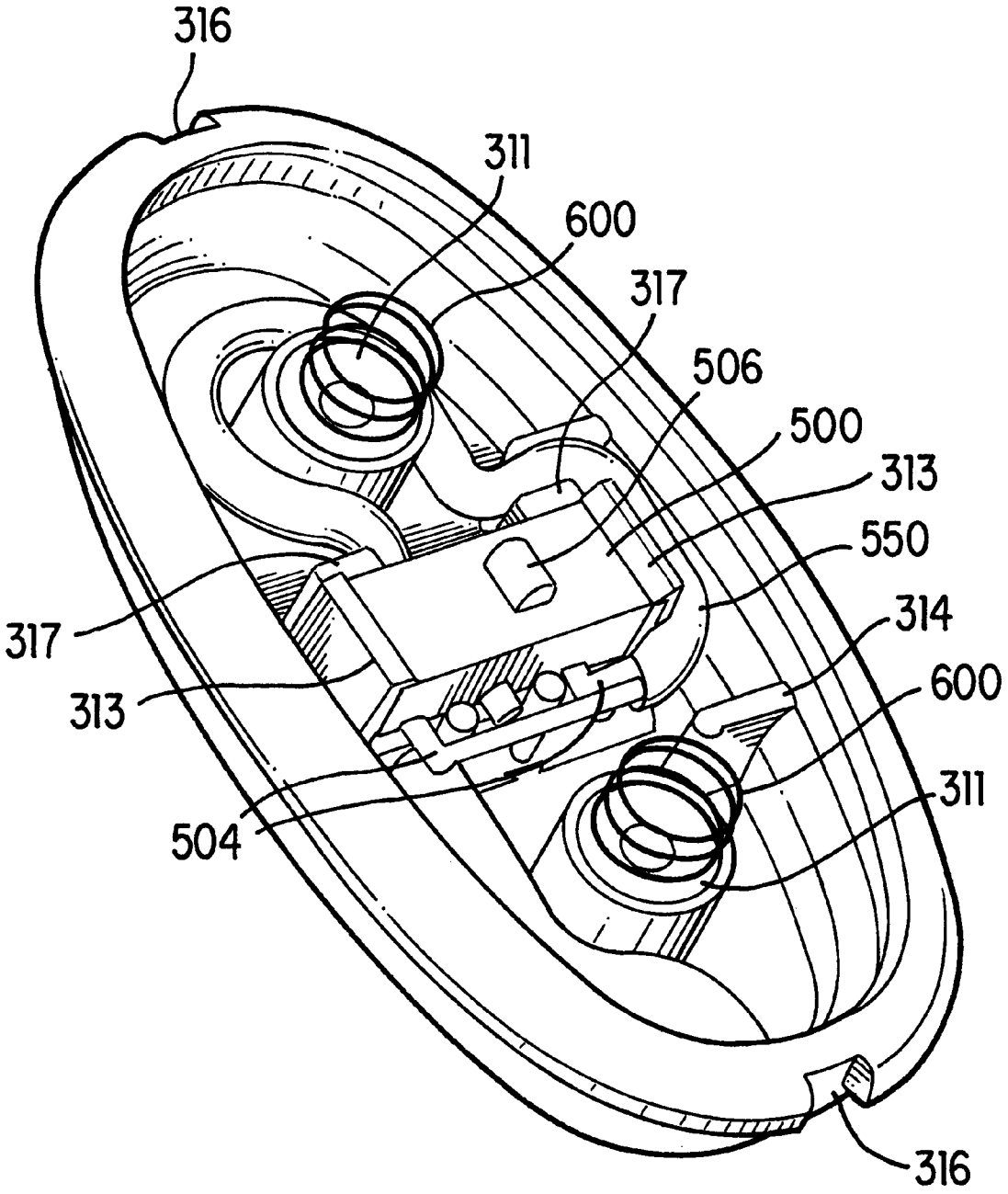
FIG. 9 is a partial view of the switch shown in FIG. 1.

FIG. 9 illustrates an assembly view of the inventive switch without the top housing 200. As shown, wire 550 is secured to the electronic switch 500 at lead terminals 504 and is guided by wire supports 314 and 319 and extends from the switch housings via wire aperture 318. Spring platforms 311 also provide guidance and reduce tension for the wire 550. The electronic switch 500 is frictionally secured within the bottom housing by clips 313 that have a proximal ledge for positively securing or "clipping" the electronic switch therein.

It should further be appreciated that other embodiments of the broader concepts of the present invention are considered, for example for use in a mechanical switch device such as a counter device. Although the preferred invention is adapted for use by a physically challenged person, the invention can be used in any application in which adverse use or adverse environmental conditions exist. For example, the switch can be used in outdoor environments or in manufacturing facilities. The switch including the ring attachment structure can also be used in various different applications, including remote activation devices, counting mechanisms, and audio visual sequencing switches, as well as for use in the medical areas for aiding communications and actions of a physically challenged person.

The housings of the switch are preferably made from plastic, but can be constructed of a variety of materials, including rubbers, metals, ceramics, etc, and are preferably sized as small as possible to fit the desired application. The seal ring can be made from rubber, plastic or other structure that provides the rigidity necessary to maintain a seal between the switch housings.

The ring structure of the switch can be made from plastic, rubber, metal or other material. The material selected for the ring should be flexible such that the ring can be formed to fit various sized appendages and people.

While the invention has been illustrated in the drawings and briefly described with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A switch, comprising:

a top housing having a top mating surface;

a bottom housing having a bottom mating surface adapted to cooperate with the top mating surface such that activation forces applied to the top housing are evenly transmitted to the bottom housing;

a ring member located adjacent to the bottom housing and configured to be attached to a user's body;

a spring mechanism disposed between the top housing and the bottom housing; and an electrical switch located between the top housing and the bottom housing.

2. The switch of claim 1, further comprising a seal member located between the top housing and the bottom housing configured to resist contaminants from entering.

3. The switch of claim 2, wherein the seal member is configured such that substantially no resilient forces are transferred between the top housing and the bottom housing via the seal member.

4. The switch of claim 2, wherein the top housing and bottom housing each include a seal ridge in which the seal member is disposed.

5. The switch of claim 1, wherein the top housing includes a clip portion that is configured to expand over and fit onto a corresponding ridge in the bottom housing such that the top and bottom housings can be quickly and easily fit together during assembly.

6. The switch of claim 1, wherein the top housing is oval in shape.

7. The switch of claim 1, wherein the top mating surface is a 3-dimensional surface.

8. The switch of claim 1, wherein the spring mechanism includes a coil spring located between and attached to the top housing and the bottom housing.

9. The switch of claim 1, wherein the bottom housing includes a lower planar portion, and the seal member is substantially planar and in substantially parallel relationship to the lower planar portion of the bottom housing.

10. The switch of claim 1, wherein the ring member is rotatably attached to the bottom housing.

11. The switch of claim 1, wherein the ring member comprises a first semi-circular member located adjacent a second semi-circular member, each of the first and second semi-circular members comprising a flexible material such that they can be adjusted to form various sized ring apertures therebetween.

12. The switch of claim 1, further comprising a ring cover plate located adjacent the bottom housing such that the ring member is sandwiched between the ring cover plate and the bottom housing.

13. A switch, comprising:

a top housing and a bottom housing movably connected to each other;

an electrical switch located between the top housing and the bottom housing and activatable by movement of the top housing relative to the bottom housing; and a ring member located adjacent the bottom housing and configured to be attachable to a user's body.

14. The switch of claim 13, wherein the ring member is rotatably attached to the bottom housing.

15. The switch of claim 13, wherein the ring member comprises a first semi-circular member located adjacent a second semi-circular member, each of the first and second semi-circular members comprising a flexible material such that they can be adjusted to form various sized ring apertures therebetween.

16. The switch of claim 13, further comprising a ring cover plate located adjacent the bottom housing such that the ring member is sandwiched between the ring cover plate and the bottom housing.

* * * * *